US007733016B2

(12) United States Patent
Lambright et al.

(10) Patent No.: US 7,733,016 B2
(45) Date of Patent: Jun. 8, 2010

(54) DEFINING ELECTRODE REGIONS OF ELECTROLUMINESCENT PANEL

(75) Inventors: Terry M. Lambright, Corvallis, OR (US); Sterling Chaffins, Corvallis, OR (US); Marshall Field, Corvallis, OR (US); Chinmay Betrabet, Corvallis, OR (US); David M Kwasny, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 789 days.

(21) Appl. No.: 11/208,110

(22) Filed: Aug. 20, 2005

(65) Prior Publication Data

US 2007/0042528 A1 Feb. 22, 2007

(51) Int. Cl.
*H01L 29/04* (2006.01)
*G09G 3/20* (2006.01)
*H01L 31/0376* (2006.01)

(52) U.S. Cl. ..... 313/509; 313/504; 313/507; 257/431; 257/59; 257/382; 257/411; 345/55; 345/80; 345/84

(58) Field of Classification Search ..... None
See application file for complete search history.

(56) References Cited

U.S. PATENT DOCUMENTS

| | | | | |
|---|---|---|---|---|
| 5,686,792 | A | 11/1997 | Ensign, Jr. | |
| 5,821,691 | A | 10/1998 | Richie et al. | |
| 5,902,688 | A | 5/1999 | Antoniadis et al. | |
| 6,338,892 | B1 | 1/2002 | McCue | |
| 6,366,017 | B1 | 4/2002 | Antoniadis et al. | |
| 6,489,631 | B2 * | 12/2002 | Young et al. | 257/59 |
| 6,738,031 | B2 * | 5/2004 | Young et al. | 345/55 |
| 6,875,524 | B2 | 4/2005 | Hatwar et al. | |
| 6,942,916 | B2 | 9/2005 | Bezenek | |
| 2003/0146019 | A1 | 8/2003 | Hirai | |
| 2003/0197461 | A1 | 10/2003 | Fukuda | |
| 2004/0043191 | A1 | 3/2004 | Zovko | |
| 2004/0178722 | A1 | 9/2004 | Cok et al. | |
| 2004/0265623 | A1 * | 12/2004 | Stegamat et al. | 428/690 |
| 2005/0090029 | A1 * | 4/2005 | Yamazaki et al. | 438/30 |
| 2005/0156261 | A1 * | 7/2005 | Nishikawa et al. | 257/431 |
| 2005/0236981 | A1 * | 10/2005 | Cok et al. | 313/504 |
| 2006/0138944 | A1 * | 6/2006 | Ray et al. | 313/506 |
| 2007/0090758 | A1 * | 4/2007 | Kwasny et al. | 313/509 |

FOREIGN PATENT DOCUMENTS

| | | |
|---|---|---|
| EP | 1520872 | 4/2005 |
| GB | 2 371 016 | 7/2002 |
| GB | 2404774 | 2/2005 |
| WO | WO2006/130582 | 12/2006 |

OTHER PUBLICATIONS

Transmittal of the International Search Report and the Written Opinion of the International Searching Authority dated Jan. 23, 2007.

* cited by examiner

*Primary Examiner*—Sikha Roy
*Assistant Examiner*—Tracie Green

(57) ABSTRACT

An electroluminescent panel includes a partial electroluminescent panel base, a layer of electrically isolated conductive areas next to the partial electroluminescent panel base, and an activatable conductive layer next to the layer of electrically isolated conductive areas. The activatable conductive layer is selectively activated to electrically connect selected electrically isolated conductive areas together to define one or more electrically isolated conductive electrode regions.

20 Claims, 3 Drawing Sheets

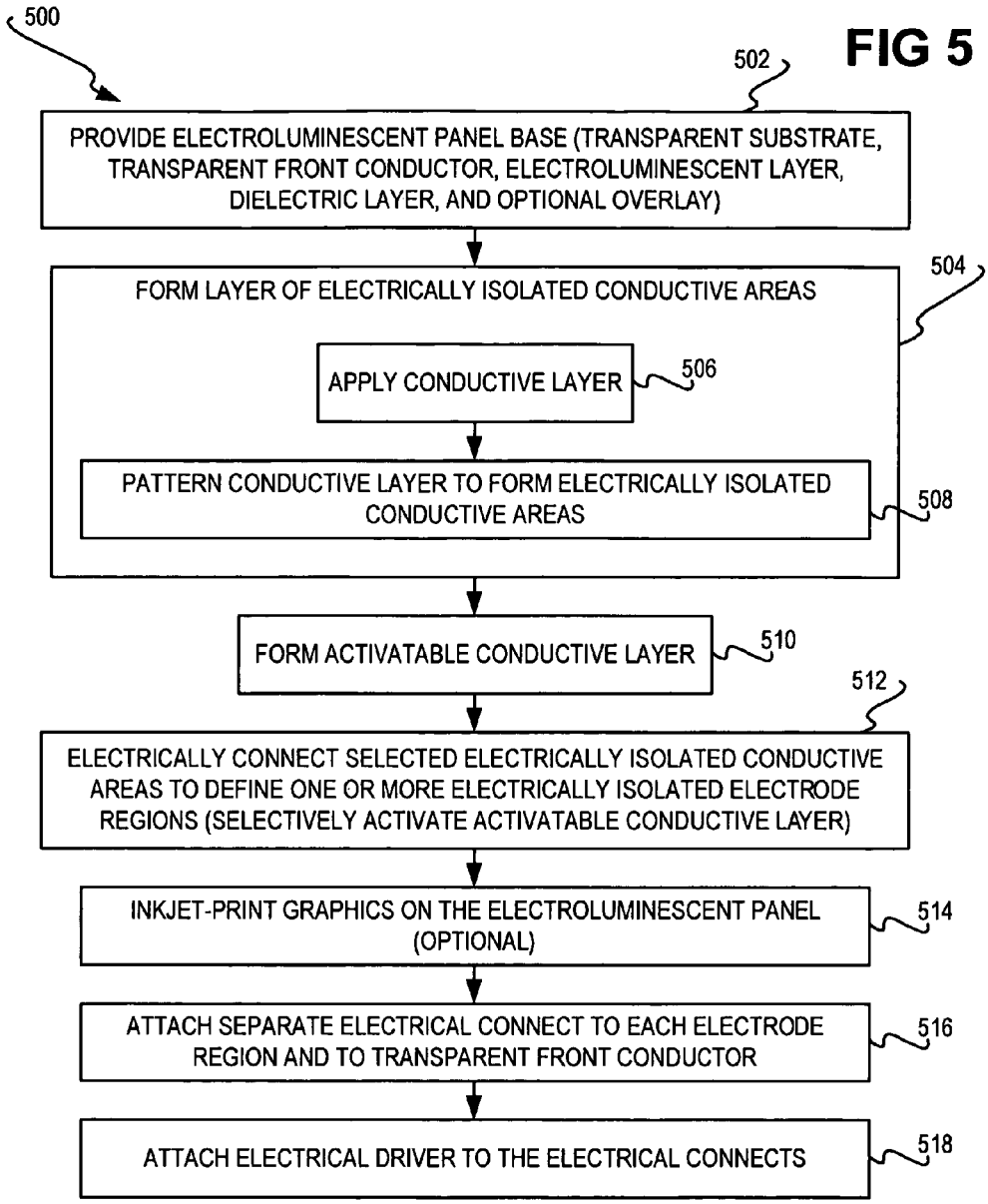
500
FIG 5
502
PROVIDE ELECTROLUMINESCENT PANEL BASE (TRANSPARENT SUBSTRATE, TRANSPARENT FRONT CONDUCTOR, ELECTROLUMINESCENT LAYER, DIELECTRIC LAYER, AND OPTIONAL OVERLAY)
504
FORM LAYER OF ELECTRICALLY ISOLATED CONDUCTIVE AREAS
APPLY CONDUCTIVE LAYER
506
PATTERN CONDUCTIVE LAYER TO FORM ELECTRICALLY ISOLATED CONDUCTIVE AREAS
508
FORM ACTIVATABLE CONDUCTIVE LAYER
510
512
ELECTRICALLY CONNECT SELECTED ELECTRICALLY ISOLATED CONDUCTIVE AREAS TO DEFINE ONE OR MORE ELECTRICALLY ISOLATED ELECTRODE REGIONS (SELECTIVELY ACTIVATE ACTIVATABLE CONDUCTIVE LAYER)
INKJET-PRINT GRAPHICS ON THE ELECTROLUMINESCENT PANEL (OPTIONAL)
514
ATTACH SEPARATE ELECTRICAL CONNECT TO EACH ELECTRODE REGION AND TO TRANSPARENT FRONT CONDUCTOR
516
ATTACH ELECTRICAL DRIVER TO THE ELECTRICAL CONNECTS
518

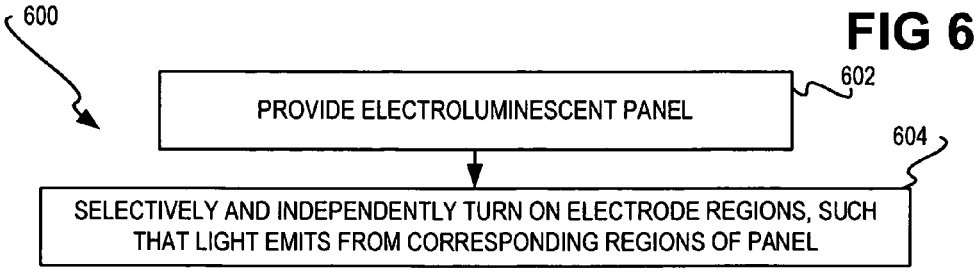
600
FIG 6
PROVIDE ELECTROLUMINESCENT PANEL
602
604
SELECTIVELY AND INDEPENDENTLY TURN ON ELECTRODE REGIONS, SUCH THAT LIGHT EMITS FROM CORRESPONDING REGIONS OF PANEL

DEFINING ELECTRODE REGIONS OF ELECTROLUMINESCENT PANEL

BACKGROUND

An electroluminescent (EL) panel includes a layer of electroluminescent phosphor powder and a dielectric sandwiched between front and rear electrodes. At least one of these electrodes is transparent. On application of a voltage, the electroluminescent phosphor emits light. One of the electrodes, usually the rear electrode, may be divided into a number of different regions, so that corresponding regions of the EL panel can be selectively and independently lit. Typically, creating the different regions of the rear electrode is accomplished by a screen-printing process. However, the screen-printing process is cost effective only for large production runs. That is, where just a small number of EL panels are desired to be made with particular independently and selectively lit regions, the screen-printing process can be cost prohibitive.

BRIEF DESCRIPTION OF THE DRAWINGS

The drawings referenced herein form a part of the specification. Features shown in the drawing are meant as illustrative of only some embodiments of the invention, and not of all embodiments of the invention.

FIG. 5 is a flowchart of a method for forming an EL panel in which rear electrode regions are defined, according to an embodiment of the invention.

FIG. 6 is a flowchart of a method for use, according to an embodiment of the invention.

DETAILED DESCRIPTION OF THE DRAWINGS

In the following detailed description of exemplary embodiments of the invention, reference is made to the accompanying drawings that form a part thereof, and in which is shown by way of illustration specific exemplary embodiments in which the invention may be practiced. These embodiments are described in sufficient detail to enable those skilled in the art to practice the invention. Other embodiments may be utilized, and logical, mechanical, electrical, electro-optical, software/firmware and other changes may be made without departing from the spirit or scope of the present invention. The following detailed description is, therefore, not to be taken in a limiting sense, and the scope of the present invention is defined only by the appended claims.

Figure 1:
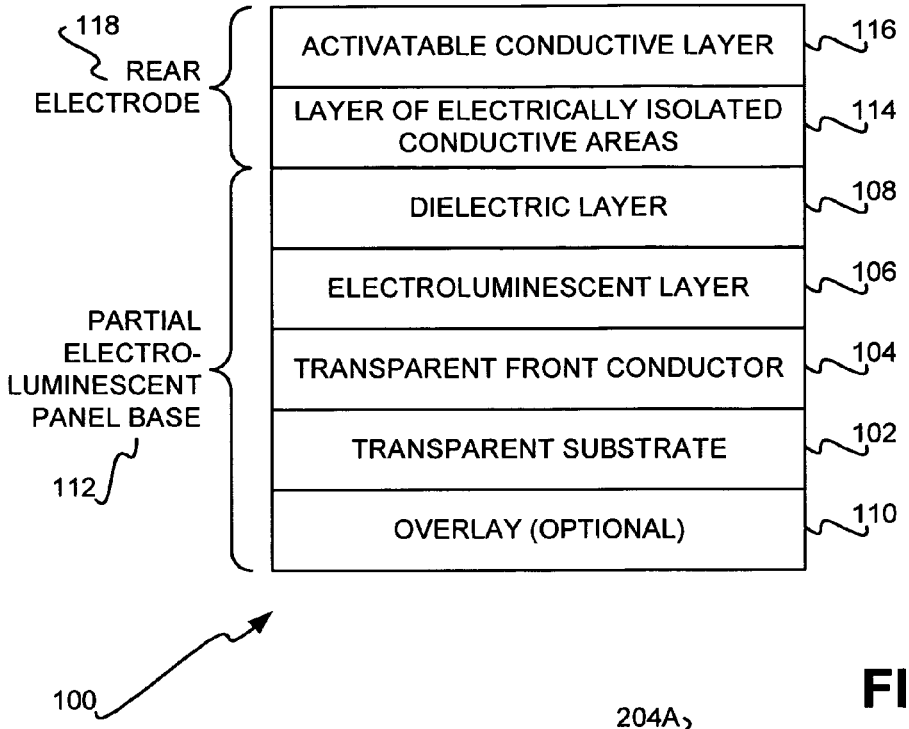
FIGS. 1 and 2 are diagrams of cross-sectional side views of an electroluminescent (EL) panel, according to an embodiment of the invention.

FIG. 1 shows a cross-sectional side view of an electroluminescent (EL) panel 100, according to an embodiment of the invention. The EL panel 100 includes a transparent substrate 102, a transparent front conductor 104 situated next to or over the transparent substrate 102, an electroluminescent layer 106 situated next to or over the transparent front conductor, or front electrode, 104, and a dielectric layer 108 situated next to or over the electroluminescent layer 106. The substrate 102, the front conductor 104, the electroluminescent layer 106, and the dielectric layer 108 may together be referred to as a partial EL panel base 112. The EL panel 100 also includes a layer 114 of electrically isolated conductor areas and an activatable conductive layer 116, which together may be referred to as a rear electrode 118, and which are particularly described later in the detailed description. The EL panel 100 may optionally include an overlay 110, which may be part of the partial EL panel base 112.

The EL panel 100 is depicted in FIG. 1 upside-down to indicate how the various layers and components of the EL panel 100 are typically fabricated. In actual use, the transparent substrate 102 is oriented so that it is positioned towards the front, or top. As a result, light from the electroluminescent layer 106 can emit therethrough, and the dielectric layer 108 is positioned towards the back, or bottom.

The transparent substrate 102 may be polyethylene terephthalate (PET), another type of clear plastic, or another type of transparent substrate material. The substrate 102 is transparent in the sense that it is at least partially or substantially transparent, and/or at least partially or substantially allows light to transmit therethrough. The transparent front conductor, or electrode, 104 may be indium tin oxide (ITO), antimony tin oxide (ATO), or another type of transparent conductive material. The conductor 104 is transparent in the sense that it is at least partially or substantially transparent, and/or at least partially or substantially allows light to transmit therethrough. The conductor 104 is a front conductor because in actual use, the conductor 104 is oriented so that it is positioned towards the front, or top, so that light from the electroluminescent layer 106 can emit there through, and the rear conductor or electrode 118 is positioned towards the back, or bottom.

The electroluminescent layer 106 may be an inorganic or organic phosphor. The dielectric layer 108 may be barium titanate powder in a polyurethane binder, or another type of dielectric. The dielectric layer 108, together with the electroluminescent layer 106, the transparent front conductor 104, and the rear conductor or electrode 118 forms a capacitor. Application of a voltage over the dielectric layer 108 energizes the electroluminescent layer 106, which causes light to be emitted from the electroluminescent layer 106. The electroluminescent layer 106 is typically not patterned.

The overlay 110 may be a plastic or another type of overlay, and may, have graphics printed thereon, such as for marketing, advertising, and/or other purposes. Alternatively, the overlay 110 may be an ink-receptive layer that is receptive to artwork or other graphics inkjet-printed thereon. Where the overlay 110 is not present, the artwork or other graphics may be directly inkjet-printed on the transparent substrate 102.

Figure 2:
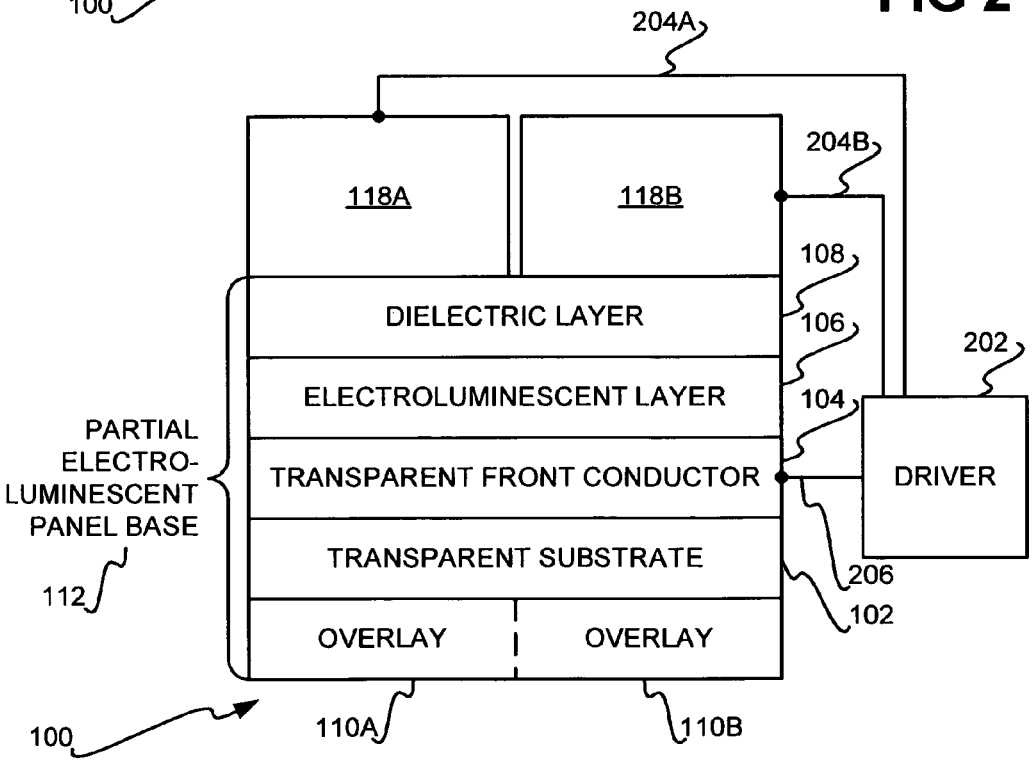

FIG. 2 shows another cross-sectional side view of the EL panel 100, according to an embodiment of the invention. In FIG. 2, the rear electrode 118 has been divided into rear electrode regions 118A and 118B, which are electrically isolated conductive regions. Electrical connects 204A and 204B are attached between the rear electrode regions 118A and 118B and a driver 202, which includes or is connected to a voltage source, such as a battery or a wall outlet. Another electrical connect 206 is attached between the transparent front conductor 104 and the driver 202.

Applying a voltage between the rear electrode region 118A and the transparent front conductor 104 energizes the capacitor formed by the region 118A, the front conductor 104, the electroluminescent layer 106, and the dielectric layer 108, such that substantially just the portion of the electroluminescent layer 106 correspondingly underneath the rear electrode region 118A emits light. This is accomplished by the driver 202 driving a voltage between the electrical connect 204A and the electrical connect 206. Similarly, applying a voltage between the rear electrode region 118B and the transparent front conductor 104 energizes the capacitor formed by the region 118B, the front conductor 104, the electroluminescent layer 106, and the dielectric layer 108, such that substantially just the portion of the electroluminescent layer 106 correspondingly underneath the rear electrode region 118B emits light. This is accomplished by the driver 202 driving a voltage between the electrical connect 204B and the electrical connect 206.

Therefore, the rear electrode regions 118A and 118B are defined in accordance with a number, and shape, of regions of the EL panel 100 that are desired to be selectively and independently illuminated. In FIG. 2, there are two such rear electrode regions, for illustrative and descriptive convenience. However, there can be any number of different rear electrode regions in any number of different shapes and sizes. Each of the rear electrode regions corresponds to a region of the EL panel 100 as a whole that can be selectively and independently illuminated. The manner by which the rear electrode regions are defined is described later in the detailed description.

It is noted that driving a voltage between the electrical connect 204A and the electrical connect 206 is independent of driving a voltage between the electrical connect 204B and the electrical connect 206. Therefore, either a voltage may be driven between the connects 204A and 206, between the connects 204B and 206, or between both the connects 204A and 204B and the connect 206. Thus, either a region of the EL panel 100 corresponding to the rear electrode region 118A can be illuminated, a region of the EL panel 100 corresponding to the rear electrode region 118B can be illuminated, or regions of the EL panel 100 corresponding to both the rear electrode regions 118A and 118B can be illuminated.

The overlay 110 may further be divided into overlay regions 110A and 110B corresponding to the rear electrode regions 118A and 118B. Therefore, the overlay 110 may be said to be aligned to the rear electrode 118, so that when the rear electrode region 118A is energized, the overlay region 110A is illuminated, and when the rear electrode region 118B is energized, the overlay region 110B is illuminated. Where the overlay 110 is not present, but where graphics are inkjet-printed directly on the transparent substrate 102, the transparent substrate 102 may alternatively be said to be divided into regions corresponding to the rear electrode regions 118A and 118B.

Figure 3:
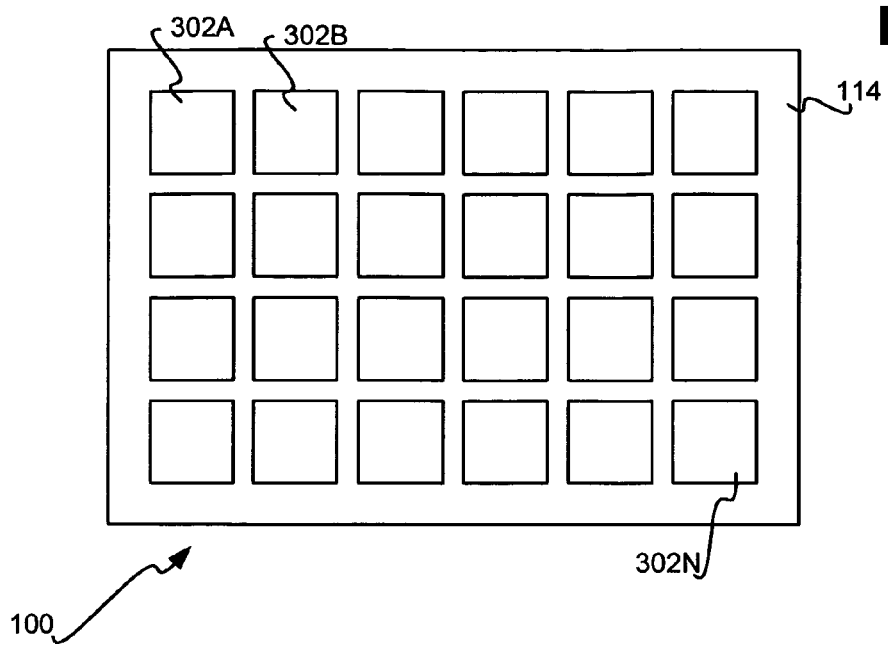
FIG. 3 is a diagram of a cross-sectional top view of an EL panel, in which a layer of electrically isolated conductive areas is shown, according to an embodiment of the invention.

FIG. 3 shows a cross-sectional top view of the EL panel 100, not including the activatable conductive layer 116, according to an embodiment of the invention. Thus, FIG. 3 depicts a top view of the layer 114 of electrically isolated conductive areas of the EL panel 100. The layer 114 includes electrically isolated conductive areas 302A, 302B, . . . , 302N, collectively referred to as the electrically isolated conductive areas 302. Within the layer 114 itself, each of the conductive areas 302 is electrically isolated from other of the conductive areas 302, and this is why the conductive areas 302 are referred to as the electrically isolated conductive areas 302.

As depicted in FIG. 3, the conductive areas 302 are organized as a grid, are at least substantially uniform in size, are rectangularly shaped, and are at least substantially uniformly spaced apart. However, in other embodiments, the conductive areas 302 may not be organized as a grid, may not be at least substantially uniform in size, may not be rectangularly shaped, and/or may not be at least substantially uniformly spaced apart. The conductive areas 302 may be small, and thus may be measured in densities of areas per inch, or they may be large, and thus may be measured individually in inches. The conductive areas 302 may further be silver conductive areas, copper conductive areas, nickel conductive areas, ultraviolet (UV)-curable conductive areas, and/or photolithographically defined conductive areas.

Figure 4:
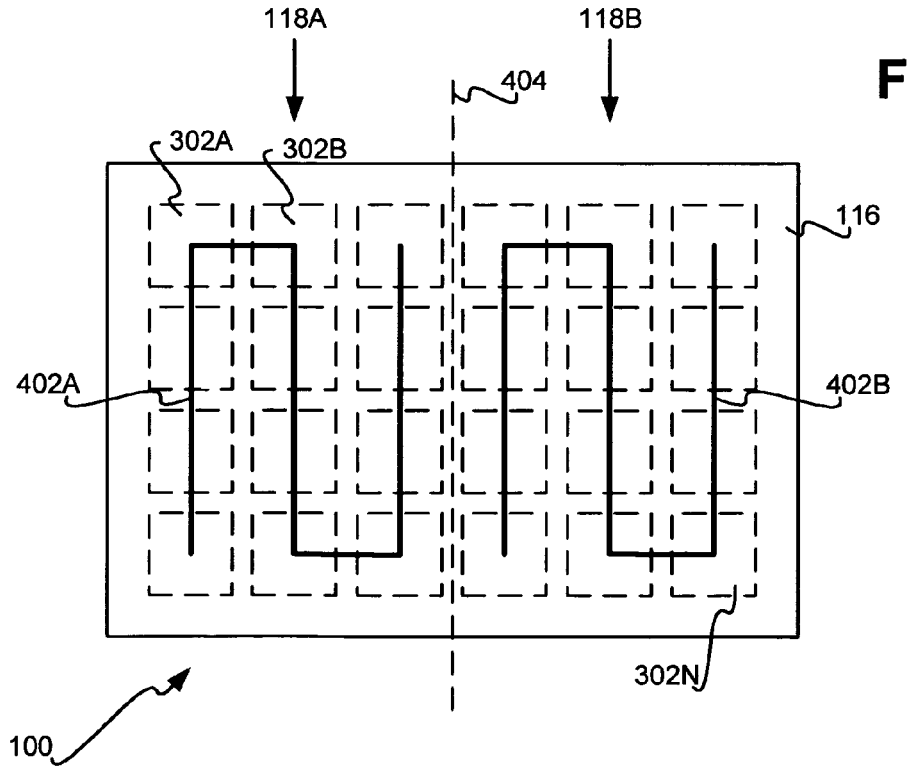
FIG. 4 is a diagram of a top view of an EL panel, in which an activatable conductive layer is shown, according to an embodiment of the invention.

FIG. 4 shows a top view of the EL panel 100, according to an embodiment of the invention, and thus depicts a top view of the activatable conductive layer 116. The conductive areas 302 of the layer 114 are depicted as dotted lines in FIG. 4 for illustrative and descriptive convenience and clarity. That is, while the activatable conductive layer 116 is typically not transparent, such that the conductive areas 302 of the layer 114 are typically not visible through the activatable conductive layer 116, the conductive areas 302 are shown in FIG. 4 for illustrative and descriptive convenience and clarity.

The activatable conductive layer 116 is initially nonconductive. However, when activated, the activatable conductive layer 116 becomes conductive. More particularly, the activatable conductive layer 116 remains nonconductive at locations thereof that have not been activated, and becomes conductive at locations thereof that have been activated. In one embodiment, the activatable conductive layer 116 is an optical-beam activated conductive layer, such as a laser-activated conductive layer. In such an embodiment, the layer 116 becomes conductive where exposed to an optical beam having a wavelength to which the layer 116 is sensitive, and remains nonconductive where the layer 116 is not exposed to the optical beam.

For instance, such an optically activated conductive layer is described in the previously filed, copending, and coassigned patent application entitled "Conductive Patterning," filed on Jun. 1, 2005, and assigned Ser. No. 11/142,699. The wavelength of light to which such an optically activated conductive layer is sensitive may be 780 nanometers (nm). The layer 116 may be applied to or over the layer 114 having the conductive areas 302 as a paste, which then hardens into the layer 116. The paste may be a silver paste in one embodiment, and may change color at locations at which it has been activated and thus is conductive.

The activatable conductive layer 116 is selectively activated to electrically connect selected areas of the electrically isolated conductive regions 302 of the layer 114 to define the electrically isolated electrode regions 118A and 118B. For instance, the layer 116 is activated at the segmented lines 402A and 402B in FIG. 4 and becomes conductive at the segmented lines 402A and 402B, such that the layer 116 remains nonconductive elsewhere, other than at the segmented lines 402A and 402B. The segmented line 402A electrically connects the conductive regions 302 to the left of the dotted line 404, whereas the segmented line 402B electrically connects the conductive regions 302 to the right of the dotted line 404. However, the conductive regions 302 to the left of the dotted line 404 remain electrically isolated and disconnected from the conductive regions 302 to the right of the dotted line 404.

By electrically connecting together the conductive regions 302 to the left of the dotted line 404, the activatable conductive layer 116 effectively defines the electrode region 118A, and by electrically connecting together the conductive regions 302 to the right of the dotted line 404, the activatable conductive layer 116 effectively defines the electrode region 118B. Because the conductive regions 302 to the left of the dotted line 404 remain electrically isolated from the conductive regions 302 to the right of the dotted line 404, the electrode regions 118A and 118B are themselves electrically isolated from one another. The electrode region 118A encompasses the conductive regions 302 to the left of the dotted line 404, and the electrode region 118B encompasses the conductive regions 302 to the right of the dotted line 404.

EL panels like the EL panel 100 may be manufactured in large runs, or in bulk, where the activatable conductive layers thereof are not initially activated. To construct a particular EL panel, such as the EL panel 100, having particular electrode regions, such as the electrode regions 118A and 118B, the activatable conductive layer of a given manufactured-in-bulk EL panel is selectively activated to electrically connect selected electrically isolated conductive regions to define desired electrode regions. That is, the EL panels themselves may be fabricated in a mass-produced, cost-effective manner, and can subsequently be customized by defining the desired electrode regions via selectively activating the activatable conductive layer to electrically connect selected electrically isolated conductive regions. Additionally, customized graphics may be applied to the EL panels via inkjet-printing on the overlays or on the transparent substrates of the panels.

Definition of the electrode regions 118A and 118B is accomplished as has been described in relation to FIG. 4 by activating the activatable conductive layer 116 to electrically connect the electrically isolated conductive regions 302 of the layer 114. Just a small portion of the conductive layer 116 has to be activated to perform this electrical connection of the conductive regions 302. For instance, in FIG. 4, just two segmented lines 402A and 402B of the layer 116 are activated to electrically connect the regions 302 as desired to form the electrode regions 118A and 118B. The vast majority of the activatable conductive layer 116 remains unactivated and nonconductive in FIG. 4.

Having to activate just a small portion of the conductive layer 116 to define the electrode regions 118A and 118B is advantageous, because activation may be a slow process. Using a laser beam to optically activate an optically activatable conductive layer may particularly be a slow process, for instance. Just a small portion of the conductive layer 116 has to be activated because the activatable conductive layer 116 itself does not solely make up the rear electrode 118, but rather the activatable conductive layer 116 together with the layer 114 of the conductive areas 302 makes up the rear electrode 118.

In other words, if the electrode regions 118A and 118B of the rear electrode 118 were defined just by the activatable conductive layer 116, then nearly all of the conductive layer 116 may have to be activated. However, because the electrode regions 118A and 118B of the rear electrode 118 are defined by the conductive areas 302 of the layer 114 being electrically connected by the activatable conductive layer 116, just a small portion of the conductive layer 116 may have to be activated. Therefore, having the rear electrode 118 made up of the activatable conductive layer 116 and the layer 114 of electrically isolated conductive areas 302 allows for definition of the electrode regions 118A and 118B to occur more quickly when selectively activating the activatable conductive layer 116.

FIG. 5 shows a method 500 of forming the EL panel 100 that has been described, in which the electrode regions 118 are defined, according to an embodiment of the invention. As can be appreciated by those of ordinary skill within the art, the method 500 may include other parts, steps, and/or acts, in addition to and/or in lieu of those depicted in FIG. 5. The EL panel base 112 is first provided (502). As has been described, the EL panel base 112 includes the transparent substrate 102, the transparent front conductor or electrode 104, the electroluminescent layer 106, the dielectric layer 108, and optionally the overlay 110.

The layer 114 of the electrically isolated conductive areas 302 is then formed next to or over the EL panel base 112 (504). In one embodiment, the layer 114 may be formed by applying a conductive layer (506), and then photolithographically or otherwise patterning this conductive layer (508) to form the individually electrically isolated conductive areas 302. The activatable conductive layer 116 is formed next to or over the layer 114 (510). For instance, an optical beam-activated conductive paste may be applied to the layer 114, which when hardened forms the layer 116.

Selected areas of the electrically isolated conductive areas 302 are next electrically connected to define the electrode regions 118A and 118B (512). More particularly, the activatable conductive layer 116 is selectively activated to electrically connect the electrically isolated conductive areas 302 together as desired to define the electrode regions 118A and 118B. For instance, an optical beam, such as a laser, may be selectively emitted on the activatable conductive layer 116 to selectively activate the layer 116 and render it selectively conductive.

Graphics may optionally be inkjet-printed on the EL panel 100 (514), such as on the overlay 110, or directly on the transparent substrate 102. A separate electrical connect is attached for and to each of the electrode regions 118A and 118B, as well as to the transparent front conductor 104 (516). For instance, the electrical connects 204A and 204B are attached to the electrode regions 118A and 118B, respectively, and the electrical connect 206 is attached to the transparent front conductor 104. Finally, the electrical driver 202 is attached to all of the electrical connects 204A, 204B, and 206 (518).

Finally FIG. 6 shows a rudimentary method of use 600 for the EL panel 100 that has been formed as has been described, according to an embodiment of the invention. The EL panel 100 is initially provided (602), where the EL panel 100 includes rear electrode regions 118A and 118B encompassing different of the electrically isolated conductive regions 302 as electrically connected via selective activation of the activatable conductive layer 116. The EL panel 100 may further have graphics inkjet-printed thereon, as has been described. Thereafter, the rear electrode regions 118A and 118B are selectively and independently turned on, or energized (604), so that light emits from corresponding regions of the EL panel 100.

It is noted that, although specific embodiments have been illustrated and described herein, it will be appreciated by those of ordinary skill in the art that any arrangement is calculated to achieve the same purpose may be substituted for the specific embodiments shown. As just one example, whereas embodiments of the invention have been substantially described in relation to defining rear electrode regions of an EL panel, other embodiments of the invention may be implemented in relation to defining other electrode regions, such as front electrode regions. This application is thus intended to cover any adaptations or variations of the present invention. Therefore, it is manifestly intended that this invention be limited only by the claims and equivalents thereof.

We claim:

1. A electroluminescent panel comprising:

a partial electroluminescent panel base having an electroluminescent layer;

a layer of conductive areas next to the partial electroluminescent panel base; and, an activatable layer next to the layer of conductive areas, the activatable layer being different than the electroluminescent layer of the partial electroluminescent panel base, the activatable layer being different than the layer of conductive areas, wherein the electroluminescent panel is adapted to being customizable, after production of the electroluminescent panel, via the activatable layer being selectively activated, wherein the activatable layer comprises:

one or more activated regions that are conductive due to their being activated, each activated region electrically connecting a number of the conductive areas together such that the number of the conductive areas are electrically isolated from one another but for the activated region electrically connecting the number of the conductive areas together;

wherein the layer of conductive areas comprises:

a plurality of electrically isolated conductive electrode regions, each electrode region uniquely corresponding to one of the activated regions of the activatable layer and encompassing the number of the conductive areas electrically connected together by the one of the activated regions, the electrically isolated conductive electrode regions lesser in number than the conductive areas, and wherein the conductive areas that are not electrically connected together by any of the activated regions of the activatable layer are electrically isolated from one another.

2. The electroluminescent panel of claim 1, wherein each electrically isolated conductive electrode region encompasses a different plurality of the conductive areas.

3. The electroluminescent panel of claim 1, wherein the electrode regions are capable of being independently and selectively powered, such that light emits from corresponding regions of the electroluminescent panel.

4. The electroluminescent panel of claim 1, wherein the activatable layer comprises an optical beam-activated conductive layer, such that the layer is conductive where exposed to an optical beam having a wavelength to which the layer is sensitive.

5. The electroluminescent panel of claim 1, wherein the activatable layer comprises an activatable conductive paste applied next to the layer of electrically isolated conductive areas.

6. The electroluminescent panel of claim 1, wherein the layer of electrically isolated conductive areas are at least substantially uniform in size and at least substantially uniformly spaced apart.

7. The electroluminescent panel of claim 1, wherein the layer of conductive areas are organized as a grid.

8. The electroluminescent panel of claim 1, wherein the layer of conductive areas is selected from: silver conductive areas, copper conductive areas, nickel conductive areas, ultraviolet (UV)-curable conductive areas, photolithographically defined conductive areas and combinations thereof.

9. The electroluminescent panel of claim 1, wherein the partial electroluminescent panel base comprises:

a transparent substrate;

a transparent conductor next to the transparent substrate, the electroluminescent layer next to the transparent conductor; and, a dielectric next to the layer of electrically isolated conductive areas.

10. The electroluminescent panel of claim 1, wherein the partial electroluminescent panel base further comprises an overlay next to the transparent substrate on which graphics are inkjet-printed.

11. The electroluminescent panel of claim 1, wherein graphics are inkjet-printed to the partial electroluminescent panel base.

12. The electroluminescent panel of claim 1, further comprising an electrical connect attached to each electrically isolated conductive electrode region.

13. The electroluminescent panel of claim 1, further comprising an electrical driver electrically coupled to each electrically isolated conductive electrode region.

14. A electroluminescent panel comprising:

a partial electroluminescent panel base having an electroluminescent layer;

a layer of conductive areas next to the partial electroluminescent base; and, an activatable layer next to the layer of conductive areas, the activatable layer being different than the electroluminescent layer of the partial electroluminescent panel base and different than the layer of conductive areas, wherein the activatable layer comprises:

one or more activated regions that are conductive due to their being activated, each activated region electrically connecting a number of the conductive areas together such that the number of the conductive areas are electrically isolated from one another but for the activated region electrically connecting the number of the conductive areas together;

wherein the layer of conductive areas comprises:

a plurality of electrically isolated conductive electrode regions adapted to being defined after production of the electroluminescent panel to customize the electroluminescent panel, each electrode region uniquely corresponding to one of the activated regions of the activatable layer and encompassing the number of the conductive areas electrically connected together by the one of the activated regions, the electrically isolated conductive electrode regions lesser in number than the conductive areas, and wherein the conductive areas that are not electrically connected together by any of the activated regions of the activatable layer are electrically isolated from one another.

15. The electroluminescent panel of claim 14, wherein the activatable layer comprises an optical beam-activated conductive layer, such that the layer is conductive where exposed to an optical beam having a wavelength to which the layer is sensitive.

16. The electroluminescent panel of claim 14, wherein the activatable layer comprises an activatable conductive paste applied to the layer of electrically isolated conductive areas.

17. A electroluminescent panel comprising:

a partial electroluminescent panel base having an electroluminescent layer;

a layer of conductive areas next to the partial electroluminescent panel base; and, an activatable layer next to the layer of conductive areas, the activatable layer being different than the electroluminescent layer of the partial electroluminescent panel base and different than the layer of conductive areas, wherein the activatable layer comprises:

one or more activated regions that are conductive due to their being activated, each activated region electrically connecting a number of the conductive areas together such that the number of the conductive areas are electrically isolated from one another but for the activated region electrically connecting the number of the conductive areas together;

wherein the layer of conductive areas comprises:

one or more electrically isolated conductive electrode regions, each electrode region uniquely corresponding to one of the activated regions of the activatable layer and encompassing the number of the conductive areas electrically connected together by the one of the activated regions, the electrically isolated conductive electrode regions lesser in number than the conductive areas, and wherein the conductive areas that are not electrically connected together by any of the activated regions of the activatable layer are electrically isolated from one another.

18. The electroluminescent panel of claim 17, wherein the partial electroluminescent panel base comprises:

a transparent substrate;

a transparent conductor next to the transparent substrate, the electroluminescent layer next to the transparent conductor; and, a dielectric next to the layer of electrically isolated conductive areas.

19. The electroluminescent panel of claim 17, wherein the partial electroluminescent panel base further comprises an overlay next to the transparent substrate on which graphics are inkjet-printed.

20. The electroluminescent panel of claim 17, wherein graphics are inkjet-printed to the partial electroluminescent panel base.

* * * * *